US010985490B1

(12) United States Patent
Ding et al.

(10) Patent No.: US 10,985,490 B1
(45) Date of Patent: Apr. 20, 2021

(54) SAFETY SOCKET

(71) Applicant: Dongguan Keben Electrical Appliance Co., Ltd., Dongguan (CN)

(72) Inventors: Sheng Ding, Dongguan (CN); Li Qin Ye, Dongguan (CN); Chen Yuan Cheng, Keelung (TW); To Yung, Hong Kong (CN); Yu-Hung Hsiao, Taipei (TW)

(73) Assignee: Dongguan Keben Electrical appliance Co., Ltd., Dongguan (CN)

( * ) Notice: Subject to any disclaimer, the term of this patent is extended or adjusted under 35 U.S.C. 154(b) by 0 days.

(21) Appl. No.: 16/808,815

(22) Filed: Mar. 4, 2020

(51) Int. Cl.
*H01R 13/703* (2006.01)
*H01R 13/443* (2006.01)
*H01R 24/76* (2011.01)
*H01R 13/506* (2006.01)

(52) U.S. Cl.
CPC ..... *H01R 13/443* (2013.01); *H01R 13/506* (2013.01); *H01R 13/703* (2013.01); *H01R 24/76* (2013.01)

(58) Field of Classification Search
CPC . H01R 13/703; H01R 13/713; H01R 13/7036
See application file for complete search history.

(56) References Cited

U.S. PATENT DOCUMENTS 5,320,545 A * 6/1994 Brothers ..... H01R 13/7036 200/51.09
5,865,635 A * 2/1999 Hsiang ..... H01R 13/4534 200/51.09
6,111,210 A * 8/2000 Allison ..... H01R 13/7036 200/51.09
6,455,789 B1 * 9/2002 Allison ..... H01R 13/7036 200/51.09
7,070,432 B1 * 7/2006 Lin ..... H01R 13/7032 200/51.09
7,884,292 B2 * 2/2011 Zhang ..... H01R 24/78 200/51.02
7,887,349 B1 * 2/2011 Macomber ..... H01R 13/652 439/188
7,967,620 B1 * 6/2011 Baldwin ..... H01R 13/713 439/188

(Continued)

*Primary Examiner* — Ross N Gushi
(74) *Attorney, Agent, or Firm* — Lin & Associates Intellectual Property, Inc.

(57) ABSTRACT

A safety socket is provided, comprising: a neutral-wire conductive base, a live-wire conductive base, an insulator, a neutral-wire wiring terminal, a live-wire wiring terminal, and a live-wire connection piece. The insulator is disposed between the neutral-wire conductive base and the live-wire conductive base. The contact of the neutral-wire wiring terminal is close to the contact of the first end of the neutral-wire conductive base. The live-wire wiring terminal is disposed between the live-wire conductive base and the insulator. The two contacts of the live-wire connection piece are respectively close to the contact of the second end of the live-wire conductive base and the contact of the live-wire wiring terminal. The invention can prevent electric shock when a conductive non-plug foreign body is inserted to provide high safety. The overall structure of the invention is simplified and easy to assemble, to achieve reducing manufacturing costs, and facilitating mass production.

10 Claims, 9 Drawing Sheets

(56) References Cited

U.S. PATENT DOCUMENTS

| | | | | |
|---|---|---|---|---|
| 8,297,996 | B2 * | 10/2012 | Chuang | H01R 13/7032<br>439/188 |
| 10,243,296 | B2 * | 3/2019 | Cheng | H01R 13/18 |
| 2020/0136321 | A1 * | 4/2020 | Hu | H01R 13/447 |

* cited by examiner

SAFETY SOCKET

BACKGROUND OF THE INVENTION

1. Field of the Invention

The present invention relates generally to a socket structure, and more particularly, to a safety socket for preventing electric shock when a conductive non-plug foreign body is inserted.

2. The Prior Arts

Sockets are used for inserting plugs to draw power from power supplies to electrical appliances. In general, conventional sockets do not have design features for safety. Once some users without basic knowledge of electricity, such as children, insert metal objects, such as iron wires, nails, tweezers, fingers and other conductive non-plug foreign objects into the socket, it will cause an electric shock.

There are many types of safety sockets on the market aim to solve the above problems. However, the conventionally known safety sockets are all very complicated in design, with many components, and requiring much labor and time to assemble, leading to an increase in cost, disadvantageous for mass production, and relatively easy to damage, causing inconvenience.

SUMMARY OF THE INVENTION

A primary objective of the present invention is a safety socket, able to effectively prevent electric shock when a conductive non-plug foreign body is inserted, to achieve high safety.

Another object of the present invention is to provide a safety socket, with simplified overall structure, easy to assemble, effectively reducing manufacturing costs, and facilitating mass production.

Another object of the present invention is to provide a safety socket, able to provide a contact mode of three contacts to achieve conductivity.

To achieve the foregoing object, the present invention provides a safety socket, comprising: a neutral-wire conductive base, a live-wire conductive base, an insulator, a neutral-wire wiring terminal, a live-wire wiring terminal, and a live-wire connection piece; wherein the neutral-wire conductive base having a first end and a second end, and the first end of the neutral-wire conductive base having a contact; the live-wire conductive base having a first end and a second end, and the second end of the live-wire conductive base having a contact; the insulator being disposed between the second end of the neutral-wire conductive base and the first end of the live-wire conductive base; the neutral-wire wiring terminal having a contact, the contact of the neutral-wire wiring terminal being close to the contact of the first end of the neutral-wire conductive base, and the neutral-wire wiring terminal being used to connect a wire; the live-wire wiring terminal being disposed between the first end of the live-wire conductive base and the insulator, and having a contact; the live-wire wiring terminal being used to connect another wire; the live-wire connection piece having two contacts, and the contacts of the live-wire connection piece being respectively close to the contact of the second end of the live-wire conductive base and the contact of the live-wire wiring terminal.

Preferably, the neutral-wire conductive base comprises a neutral-wire elastic body and a neutral-wire socket terminal, the neutral-wire elastic body comprises a neutral-wire elastic connection portion and two neutral-wire elastic pieces, and the neutral-wire elastic connection portion connects the two neutral-wire elastic pieces at bottom end, a contact is provided on one outer side of each of the neutral-wire elastic pieces, the neutral-wire elastic pieces are respectively located at the first end and the second end of the neutral-wire conductive base; the neutral-wire socket terminal comprises a neutral-wire socket connection portion and two neutral-wire clips, the neutral-wire socket connection portion is connected to the bottom ends of the neutral-wire clips, the neutral-wire socket connection portion is located above the neutral-wire elastic connection portion, the neutral-wire elastic pieces and the neutral-wire clips constitute a neutral-wire socket; and wherein the live-wire conductive base comprises a live-wire elastic body and a live-wire socket terminal, the live-wire elastic body comprises a live-wire elastic connection portion and two live-wire elastic pieces, and the live-wire elastic connection portion connects the two live-wire elastic pieces at bottom end, a contact is provided on one outer side of each of the live-wire elastic pieces, the live-wire elastic pieces are respectively located at the first end and the second end of the live-wire conductive base; the live-wire socket terminal comprises a live-wire socket connection portion and two live-wire clips, the live-wire socket connection portion is connected to the bottom ends of the live-wire clips, the live-wire socket connection portion is located above the live-wire elastic connection portion, the live-wire elastic pieces and the live-wire clips constitute a live-wire socket.

Preferably, the safety socket further comprises a mounting base, the mounting base is recessed with a neutral-wire positioning slot and a live-wire positioning slot; wherein a neutral-wire positioning post protruding upward is disposed at a bottom of the neutral-wire positioning slot, one of the neutral-wire clips is disposed with a neutral-wire positioning portion protruding from one side, the neutral-wire positioning portion is disposed with a neutral-wire through-hole, the neutral-wire positioning portion is located in the neutral-wire positioning slot, and the neutral-wire positioning post is disposed in the neutral-wire through-hole penetratingly; and wherein, a live-wire positioning post protruding upward is disposed at a bottom of the live-wire positioning slot, one of the live-wire clips is disposed with a live-wire positioning portion protruding from one side, the live-wire positioning portion is disposed with a live-wire through-hole, the live-wire positioning portion is located in the live-wire positioning slot, and the live-wire positioning post is disposed in the live-wire through-hole penetratingly.

Preferably, two neutral-wire steps are formed at two sides of the neutral-wire positioning slot, and two neutral-wire limiting posts protruding upward are disposed at the bottom of the neutral-wire positioning slot, and the neutral-wire limiting posts are respectively located on both sides of the neutral-wire positioning post; the bottom of the neutral-wire positioning portion abuts against tops of the neutral-wire steps and the neutral-wire limiting posts, so that the neutral-wire socket terminal is hung, and the bottom of the neutral-wire socket connection portion and the top of the neutral-wire elastic connection portion are maintained at a distance; and two live-wire steps are formed at two sides of the live-wire positioning slot, and two live-wire limiting posts protruding upward are disposed at the bottom of the live-wire positioning slot, and the live-wire limiting posts are respectively located on both sides of the live-wire positioning post; the bottom of the live-wire positioning portion abuts against tops of the live-wire steps and the live-wire limiting posts, so that the live-wire socket terminal is hung, and the bottom of the live-wire socket connection portion and the top of the live-wire elastic connection portion are maintained at a distance.

Preferably, the safety socket further comprises a mounting base, the mounting base is disposed with two neutral-wire positioning blocks and two live-wire positioning blocks; wherein a notch is disposed on one side of the neutral-wire elastic connection portion and the neutral-wire socket terminal is disposed with a socket groove, the socket groove of the neutral-wire socket terminal extends from one of the neutral-wire clips to the other neutral-wire clip through the neutral-wire connection portion, and one of the neutral-wire positioning blocks is located at the notch of the neutral-wire elastic connection portion and the socket grove of the neutral-wire socket terminal and located under one of the neutral-wire clips, and the other neutral-wire positioning block is located in the socket groove of the neutral-wire socket terminal and located under the other neutral-wire clip; wherein a notch is disposed on one side of the live-wire elastic connection portion and the live-wire socket terminal is disposed with a socket groove, the socket groove of the live-wire socket terminal extends from one of the live-wire clips to the other live-wire clip through the live-wire connection portion, and one of the live-wire positioning blocks is located at the notch of the live-wire elastic connection portion and the socket grove of the live-wire socket terminal and located under one of the live-wire clips, and the other live-wire positioning block is located in the socket groove of the live-wire socket terminal and located under the other live-wire clip.

Preferably, the neutral-wire wiring terminal comprises a contact portion and a wiring portion, the contact portion of the neutral-wire wiring terminal is close to the first end of the neutral-wire conductive base and is disposed with a contact, and the wiring portion of the neutral-wire wiring terminal is used for connection to an electric wire; the live-wire wiring terminal comprises a contact portion and a wiring portion; the contact portion of the live-wire terminal is close to the insulator and is disposed with a contact; the wiring portion of the live-wire wiring terminal is used for connection to another electric wire; wherein the live-wire connection piece comprises two contact portions, one of the contact portions of the live-wire connection piece is near the second end of the live-wire conductive base and is disposed with a contact, and the other contact portion of the live-wire connection piece is located between the contact portion and the wiring portion of the live-wire wiring terminal and is disposed with a contact.

Preferably, the safety socket further comprises a mounting base, and the mounting base surrounds a neutral-wire conductive base receptacle, a live-wire conductive base receptacle, an insulator receptacle, a live-wire wiring terminal receptacle, and a live-wire connection piece receptacle; the live-wire wiring terminal receptacle is located between the neutral-wire conductive base receptacle and the live-wire conductive base receptacle, and the insulator receptacle is connected between the neutral-wire conductive base receptacle and the live-wire wiring terminal receptacle, the live-wire connection piece receptacle surrounds outer side of the live-wire conductive base receptacle with two ends communicating with the live-wire wiring terminal receptacle and the live-wire conductive base receptacle respectively; the neutral-wire conductive base is disposed in the neutral-wire conductive base receptacle, the live-wire conductive base is disposed in the live-wire conductive base receptacle, the insulator is disposed in the insulator receptacle, the contact portion of the neutral-wire wiring terminal is located in the neutral-wire conductive base receptacle, and the live-wire wiring terminal is disposed in the live-wire wiring terminal receptacle; the live-wire connection piece comprises a connection portion, and the connection portion of the live-wire connection piece is connected to the contact portions of the live-wire connection piece and is disposed in the live-wire connection piece receptacle, the contact portions of the live-wire connection piece respectively extend into the live-wire conductive base receptacle and the live-wire wiring terminal receptacle.

Preferably, the mounting base has a partition wall, which partitions the live-wire conductive base receptacle from the live-wire wiring terminal receptacle.

Preferably, two surfaces of the insulator abut against the contact portions between the second end of the neutral-wire conductive base and the contact portion of the live-wire wiring terminal, respectively.

Preferably, the contacts of the live-wire connection piece are all silver contacts and are detachably disposed on the contact portions of the live-wire connection piece, respectively.

The effect of the present invention includes effectively preventing electric shock when a conductive non-plug foreign body is inserted to achieve high safety.

Furthermore, the overall structure of the present invention is simplified and easy to assemble, can effectively reduce manufacturing costs, and is beneficial to mass production.

In addition, the present invention can provide a contact mode of three contacts to achieve the conductivity.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
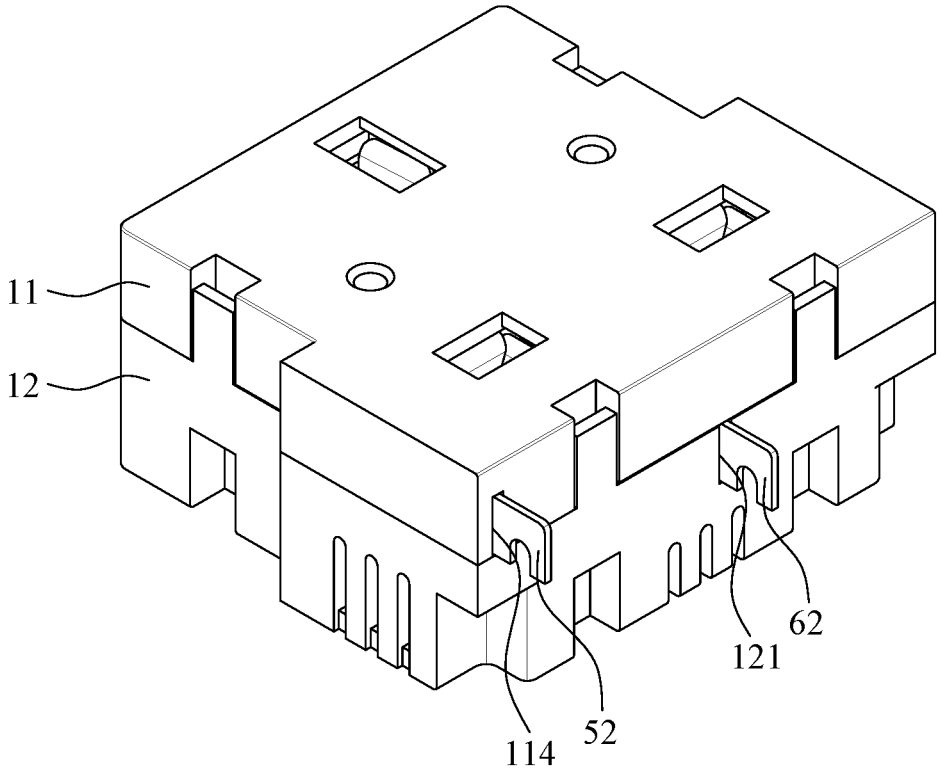
FIG. 1 is a schematic view showing the safety socket of the present invention.
Figure 2:
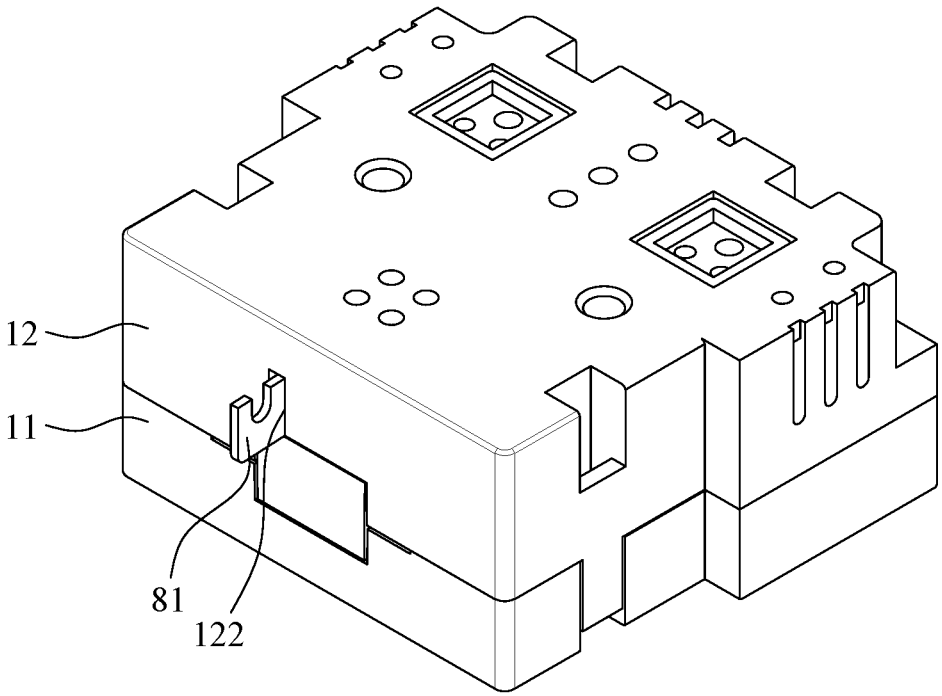
FIG. 2 is a schematic view showing of the safety socket of the present invention from a different perspective.
Figure 3:
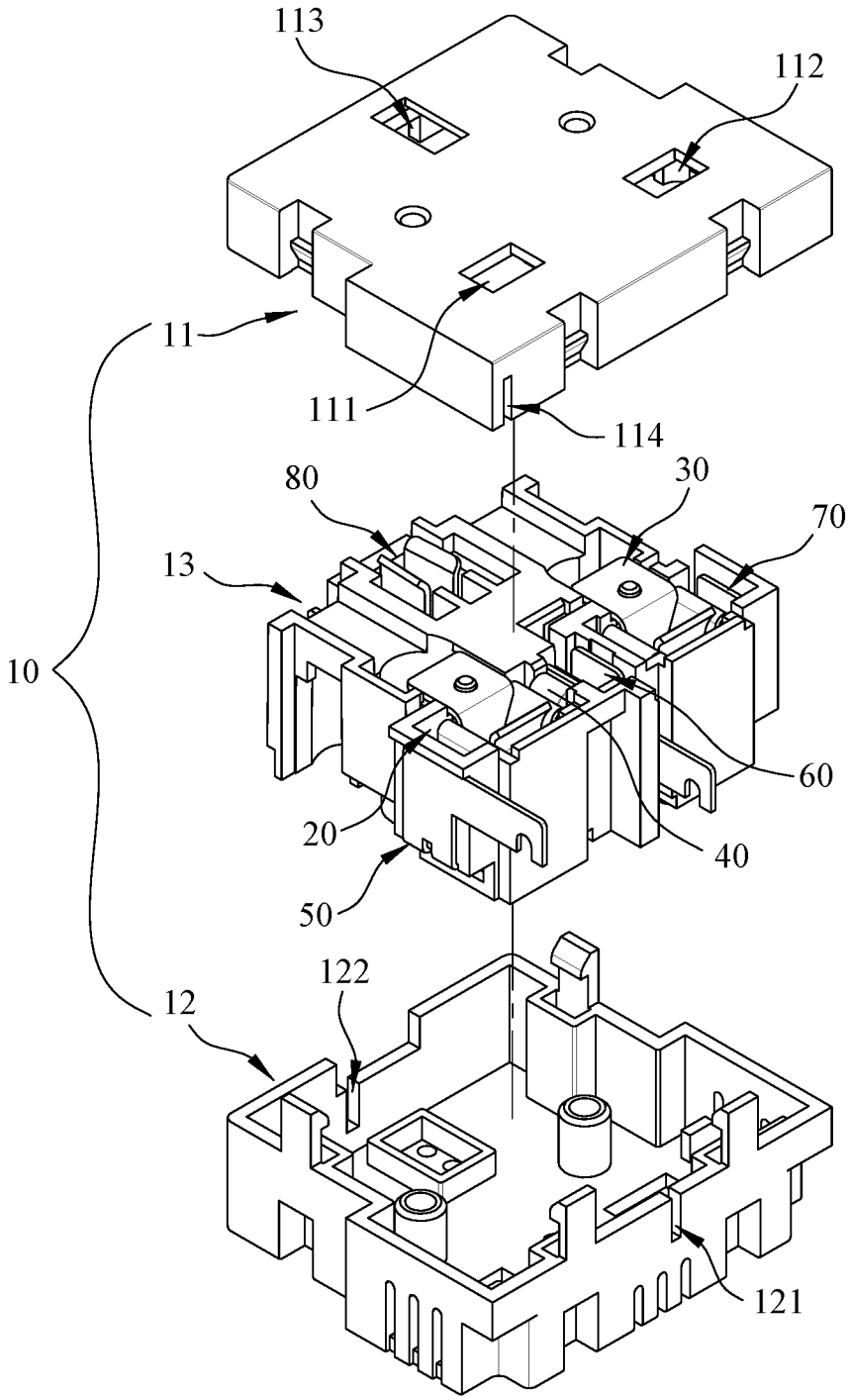
FIG. 3 is an exploded view showing the safety socket of the present invention.

Referring to FIGS. 1-3, FIG. 1 is a schematic view showing the safety socket of the present invention; FIG. 2 is a schematic view showing of the safety socket of the present invention from a different perspective; and FIG. 3 is an exploded view showing the safety socket of the present invention. The present invention provides a safety socket, comprising: a main body 10, a neutral-wire conductive base 20, a live-wire conductive base 30, an insulator 40, a neutral-wire wiring terminal 50, a live-wire wiring terminal 60, a live-wire connection piece 70, and a ground-wire conductive base 80.

As shown in FIGS. 1-3, the main body 10 comprises: a cover 11, a bottom base 12 and a mounting base 13. The cover 11 is detachably coupled to the bottom base 12 and forms an accommodation space with the bottom base 12. The mounting base 13 is disposed in the accommodation space. A neutral-wire socket hole 111, a live-wire socket hole 112, and a ground-wire socket hole 113 are disposed on the top of the cover 11; an insertion hole 114 is disposed on one side of the cover 11. Two insertion holes 121, 122 are disposed on two opposite sides of the bottom base 12.

Figure 4:
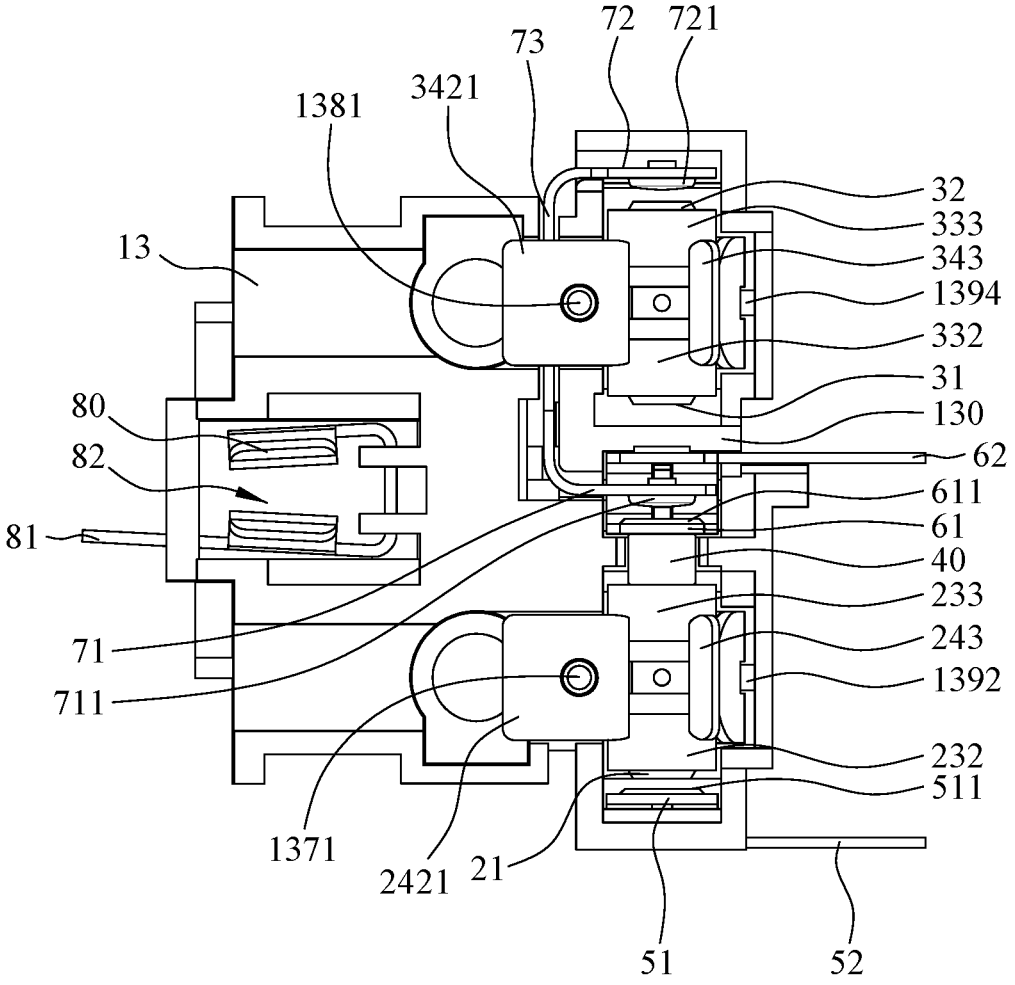
FIG. 4 is a top view of the mounting base and internal elements thereof of the present invention.
Figure 5:
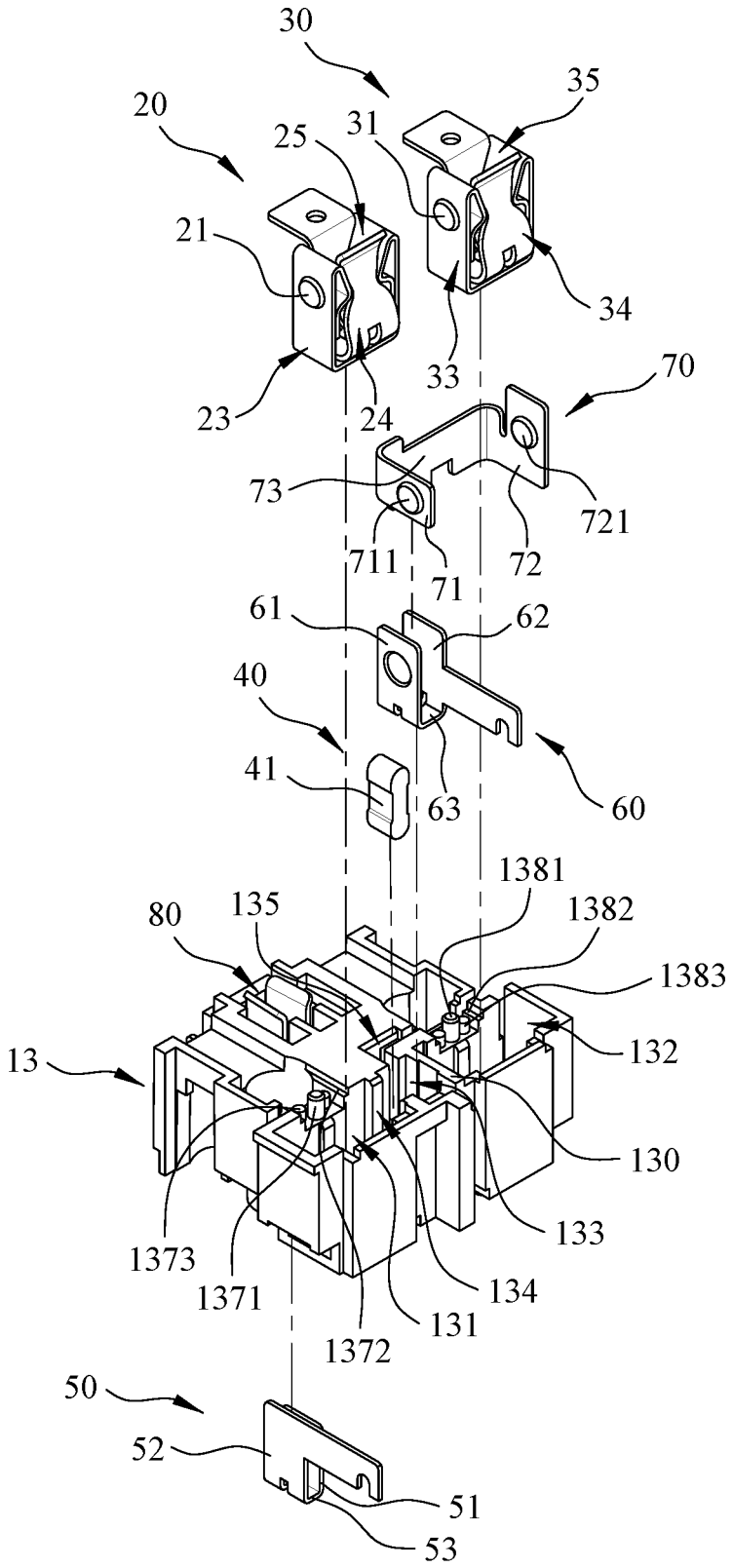
FIG. 5 is an exploded view of the mounting base and internal elements thereof of the present invention.
Figure 6:
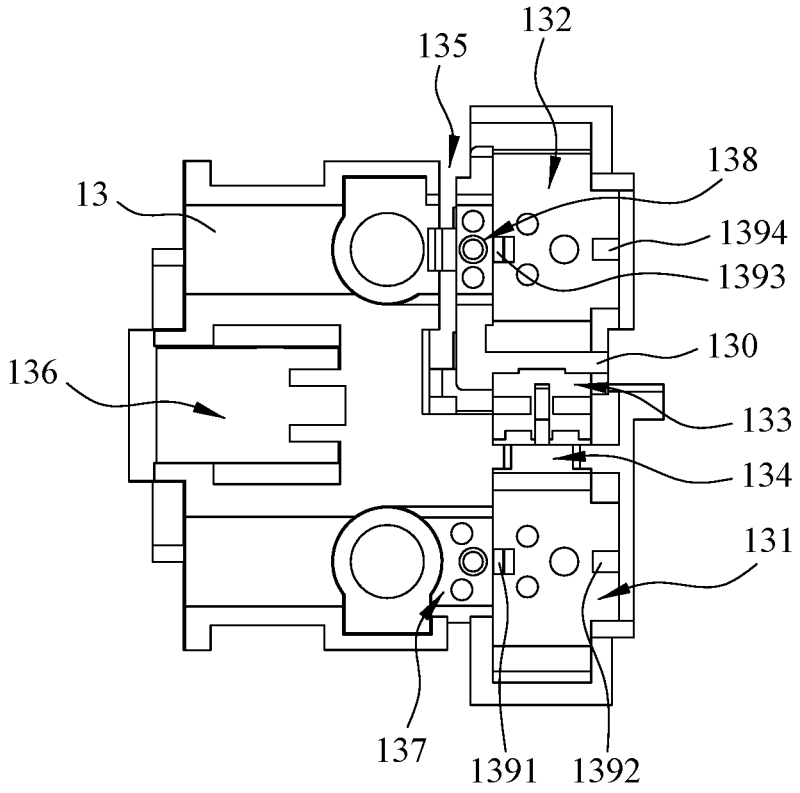
FIG. 6 is a top view of the mounting base of the present invention.

Referring to FIGS. 4-6, FIG. 4 is a top view of the mounting base 13 and internal elements thereof of the present invention; FIG. 5 is an exploded view of the mounting base 13 and internal elements thereof of the present invention; and FIG. 6 is a top view of the mounting base 13 of the present invention. The mounting base 13 surrounds a neutral-wire conductive base receptacle 131, a live-wire conductive base receptacle 132, a live-wire wiring terminal receptacle 133, an insulator receptacle 134, a live-wire connection piece receptacle 135, and a ground-wire receptacle 136; the live-wire wiring terminal receptacle 133 is located between the neutral-wire conductive base receptacle 131 and the live-wire conductive base receptacle 132, and the insulator receptacle 134 is connected between the neutral-wire conductive base receptacle 131 and the live-wire wiring terminal receptacle 133, the live-wire connection piece receptacle 135 surrounds outer side of the live-wire conductive base receptacle 132 with two ends communicating with the live-wire wiring terminal receptacle 133 and the live-wire conductive base receptacle 132, respectively.

As shown in FIGS. 4-6 and FIG. 8, the neutral-wire conductive base 20 is disposed in the neutral-wire conductive base receptacle 131 and has a first end and a second end. Each of the first and second ends of the neutral-wire conductive base 20 has a contact 21, 22, respectively. The live-wire conductive base 30 is disposed in the live-wire conductive base receptacle 132 and has a first end and a second end. Each of the first and second ends of the live-wire conductive base 30 has a contact 31, 32, respectively.

Figure 7:
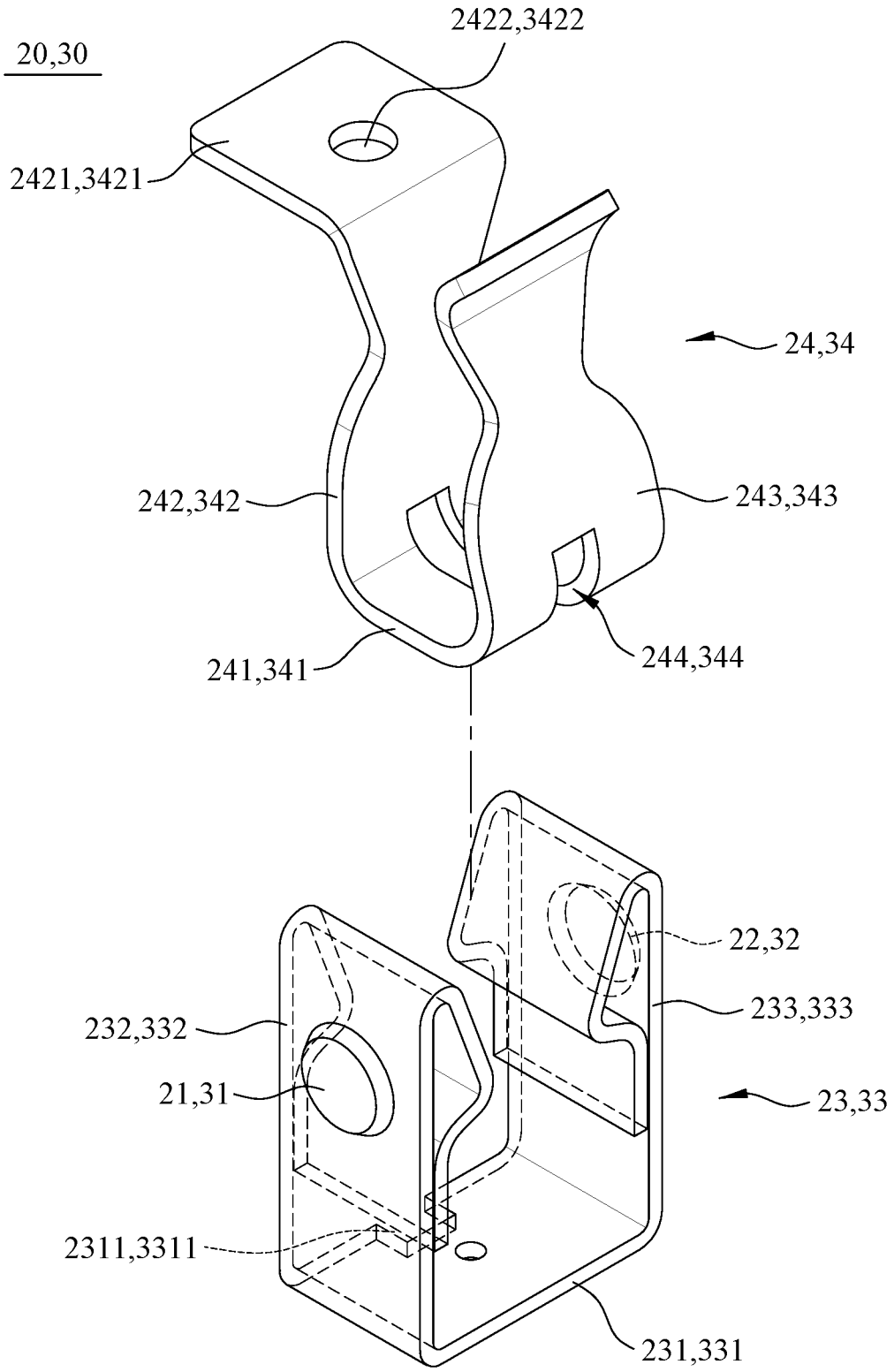
FIG. 7 is an exploded view of the neutral-wire conductive base and live-wire conductive base of the present invention.

Referring to FIG. 7, FIG. 7 is an exploded view of the neutral-wire conductive base 20 and live-wire conductive base 30 of the present invention. The neutral-wire conductive base 20 comprises a neutral-wire elastic body 23 and a neutral-wire socket terminal 24. The neutral-wire elastic body 23 comprises a neutral-wire elastic connection portion 231 and two neutral-wire elastic pieces 232, 233, and the neutral-wire elastic connection portion 231 connects the two neutral-wire elastic pieces 232, 233 at bottom end, the contact 21, 22 is provided on one outer side of each of the neutral-wire elastic pieces 232, 233. The neutral-wire elastic pieces 232, 233 are respectively located at the first end and the second end of the neutral-wire conductive base 20. The neutral-wire socket terminal 24 comprises a neutral-wire socket connection portion 241 and two neutral-wire clips 242, 243, the neutral-wire socket connection portion 241 is connected to the bottom ends of the neutral-wire clips 242, 243. The neutral-wire socket connection portion 241 is located above the neutral-wire elastic connection portion 231. The neutral-wire elastic pieces 232, 233 and the neutral-wire clips 242, 243 constitute a neutral-wire socket.

As shown in FIG. 7, the live-wire conductive base 30 comprises a live-wire elastic body 33 and a live-wire socket terminal 34. The live-wire elastic body 33 comprises a live-wire elastic connection portion 331 and two live-wire elastic pieces 332, 333, and the live-wire elastic connection portion 331 connects the two live-wire elastic pieces 332, 333 at bottom end, the contact 31, 32 is provided on one outer side of each of the live-wire elastic pieces 332, 333. The live-wire elastic pieces 332, 333 are respectively located at the first end and the second end of the live-wire conductive base 30. The live-wire socket terminal 34 comprises a live-wire socket connection portion 341 and two live-wire clips 342, 343, the live-wire socket connection portion 341 is connected to the bottom ends of the live-wire clips 342, 343. The live-wire socket connection portion 341 is located above the live-wire elastic connection portion 331, the live-wire elastic pieces 332, 333 and the live-wire clips 342, 343 constitute a live-wire socket.

As shown in FIG. 5 and FIG. 6, the mounting base 13 is recessed with a neutral-wire positioning slot 137 and a neutral-wire positioning post 1371 protruding upward is disposed at a bottom of the neutral-wire positioning slot 137. As shown in FIG. 7, the neutral-wire clip 242 is disposed with a neutral-wire positioning portion 2421 protruding from one side, the neutral-wire positioning portion 2421 is disposed with a neutral-wire through-hole 2422. As shown in FIG. 3 and FIG. 4, the neutral-wire positioning portion 2421 is located in the neutral-wire positioning slot 137, and the neutral-wire positioning post 1371 is disposed in the neutral-wire through-hole 2422 penetratingly. As such, when the neutral-wire socket terminal 24 enters the neutral-wire conductive base receptacle 131, the neutral-wire socket terminal 24 can be positioned quickly without reverse installation problem, as well as prevent the neutral-wire socket terminal 24 from moving arbitrarily.

As shown in FIG. 5 and FIG. 6, the mounting base 13 is recessed with a live-wire positioning slot 138, and a live-wire positioning post 1381 protruding upward is disposed at a bottom of the live-wire positioning slot 138. As shown in FIG. 7, one of the live-wire clips 342 is disposed with a live-wire positioning portion 3421 protruding from one side, the live-wire positioning portion 3421 is disposed with a live-wire through-hole 3422. As shown in FIG. 3 and FIG. 4, the live-wire positioning portion 3421 is located in the live-wire positioning slot 138, and the live-wire positioning post 1381 is disposed in the live-wire through-hole 3422 penetratingly. As such, when the live-wire socket terminal 34 enters the live-wire conductive base receptacle 132, the live-wire socket terminal 34 can be positioned quickly without reverse installation problem, as well as prevent the live-wire socket terminal 34 from moving arbitrarily.

Figure 8:
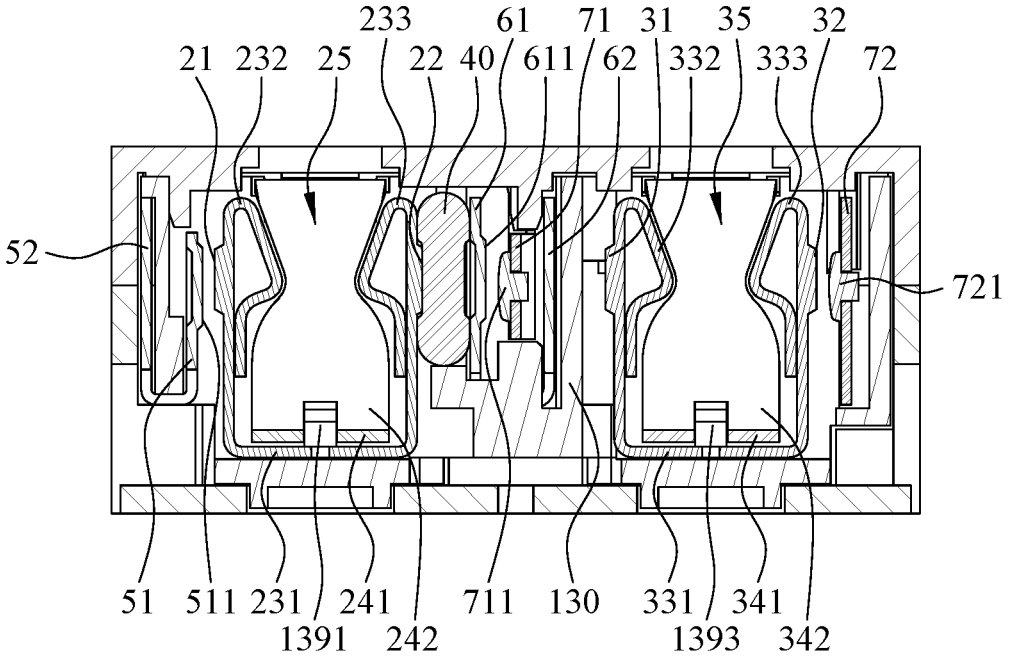
FIG. 8 is a cross-sectional view of the safety socket of the present invention.

As shown in FIG. 5 and FIG. 6, two neutral-wire steps 1372 are formed at two sides of the neutral-wire positioning slot 137, and two neutral-wire limiting posts 1373 protruding upward are disposed at the bottom of the neutral-wire positioning slot 137, the neutral-wire limiting posts are respectively located on both sides of the neutral-wire positioning post. As shown in FIG. 3 and FIG. 4, the two sides of the neutral-wire positioning portion 3421 abuts against the two neutral-wire steps 1372, and the bottom of the neutral-wire positioning portion 3421 abuts against tops of and the neutral-wire limiting posts 1373, so that the neutral-wire socket terminal 24 is hung, and the bottom of the neutral-wire socket connection portion 241 and the top of the neutral-wire elastic connection portion 231 are maintained at a distance (as shown in FIG. 8).

As shown in FIG. 5 and FIG. 6, two live-wire steps 1382 are formed at two sides of the live-wire positioning slot 138, and two live-wire limiting posts 1383 protruding upward are disposed at the bottom of the live-wire positioning slot 138, and the live-wire limiting posts 1383 are respectively located on both sides of the live-wire positioning post 1381. As shown in FIG. 3 and FIG. 4, the two sides of the live-wire positioning portion 3421 abuts against live-wire limiting posts 1382 and the bottom of the live-wire positioning portion 3421 abuts against tops of the live-wire limiting posts 1383, so that the live-wire socket terminal 34 is hung, and the bottom of the live-wire socket connection portion 341 and the top of the live-wire elastic connection portion 331 are maintained at a distance (as shown in FIG. 8).

As shown in FIG. 6, the mounting base 13 is disposed with two neutral-wire positioning blocks 1391, 1392, and the two neutral-wire positioning blocks 1391, 1392 are disposed on two opposite sides of the bottom of the neutral-wire conductive base receptacle 131. As shown in FIG. 7, a notch 2311 is disposed on one side of the neutral-wire elastic connection portion 231 and the neutral-wire socket terminal 24 is disposed with a socket groove 244, and the socket groove 244 of the neutral-wire socket terminal 24 extends from the neutral-wire clip 242 to the neutral-wire clip 243 through the neutral-wire connection portion 241. The neutral-wire positioning block 1391 is located at the notch 2311 of the neutral-wire elastic connection portion 231 and the socket grove 244 of the neutral-wire socket terminal 24 and located under one of the neutral-wire clip 242, and the neutral-wire positioning block 1392 is located in the socket groove 244 of the neutral-wire socket terminal 24 and located under the neutral-wire clip 243 (as shown in FIG. 4). As such, when the neutral-wire socket terminal 24 enters the neutral-wire conductive base receptacle 131, the neutral-wire socket terminal 24 can be positioned quickly without reverse installation problem, as well as prevent the neutral-wire socket terminal 24 from moving arbitrarily.

As shown in FIG. 6, the mounting base 13 comprises two live-wire positioning blocks 1393, 1394, and the two live-wire positioning blocks 1393, 1394 are disposed on two opposite sides of the bottom of the live-wire conductive base receptacle 132. As shown in FIG. 7, a notch 3311 is disposed on one side of the live-wire elastic connection portion 331 and the live-wire socket terminal 34 is disposed with a socket groove 344, and the socket groove 344 of the live-wire socket terminal 34 extends from the live-wire clip 342 to the live-wire clip 343 through the live-wire connection portion 341. The live-wire positioning block 1393 is located at the notch 3311 of the live-wire elastic connection portion 331 and the socket grove 344 of the live-wire socket terminal 34 and located under one of the live-wire clip 342, and the live-wire positioning block 1394 is located in the socket groove 344 of the live-wire socket terminal 34 and located under the other live-wire clip 343 (as shown in FIG. 4). As such, when the live-wire socket terminal 34 enters the live-wire conductive base receptacle 132, the live-wire socket terminal 34 can be positioned quickly without reverse installation problem, as well as prevent the live-wire socket terminal 34 from moving arbitrarily.

As shown in FIGS. 3-5 and FIG. 8, the insulator 40 is disposed in the insulator receptacle 134 and located between the neutral-wire elastic pieces 233 and the live-wire elastic pieces 332, with one surface abutting against the neutral-wire elastic piece 233. Preferably, a groove 41 is recessed on one surface of the insulator 40, and the groove 41 is used for accommodating the contact 22 on the neutral-wire elastic piece 233 to ensure that one surface of the insulator 40 is completely abutted against the neutral-wire spring elastic piece.

As shown in FIGS. 3-5 and FIG. 8, the neutral-wire wiring terminal 50 comprises a contact portion 51, a wiring portion 52, and a connection portion 53. The contact portion 51 is located in the neutral-wire conductive base receptable 131, is close to the neutral-wire elastic piece 232, and is provided with a contact 511. The contact 511 is close to the contact 21. As shown in FIG. 1 and FIG. 3, the wiring portion 52 passes through the insertion hole 114 and is used to connect a wire (not shown). The connection portion 53 connects the contact portion 51 and the bottom end of the wiring portion 52.

As shown in FIGS. 3-5 and FIG. 8, the live-wire wiring terminal 60 is disposed in the live-wire wiring terminal receptacle 133 and located between the live-wire elastic piece 332 and the insulator 40. The live-wire wiring terminal 60 comprises a contact portion 61, a wiring portion 62, and a connection portion 63. The contact portion 61 is is close to and abuts against another surface of the insulator and is disposed with a contact 611. A shown in FIG. 1, FIG. 3 and FIG. 5, the wiring portion 62 passes through the insertion hole 121 and is used to connect a wire (not shown). The connection portion 63 connects the contact portion 61 and the bottom end of the wiring portion 62.

As shown in FIGS. 3-6 and FIG. 8, the mounting base 13 has a partition wall 130, which partitions the live-wire conductive base receptacle 132 from the live-wire wiring terminal receptacle 133 so as to prevent the contact between the wiring portion 62 and the live-wire elastic piece 332.

As shown in FIGS. 3-6 and FIG. 8, the live-wire connection piece 70 comprises two contact portions 71, 72 and a connection portion 73. The contact portions 71, 72 respectively extend into the live-wire conductive base receptacle 132 and the live-wire wiring terminal receptacle 133. The contact portion 72 is close to the live-wire elastic piece 333 and is provided with a contact point 721. The contact portion 71 is located between the contact portion 61 and the wiring portion 62, and is provided with a contact 711. The contacts 721, 711 are respectively close to the contact 32 and the contact 611. The connection portion 73 connects the contact portions 71, 72 and is disposed in the live-wire connection piece receptacle 135. Preferably, the contacts 721, 711 are silver contacts and are detachably disposed on the contact portions 72, 71, respectively.

As shown in FIGS. 1-5, the ground-wire conductive base 80 is disposed in the ground-wire conductive base receptacle 136, and a wiring portion 81 of the ground-wire conductive base 80 passes through the insertion hole 122. Since the ground-wire conductive base 80 has a conventional structure and related detailed structure is well known, the detailed description will be omitted herein.

Figure 9:
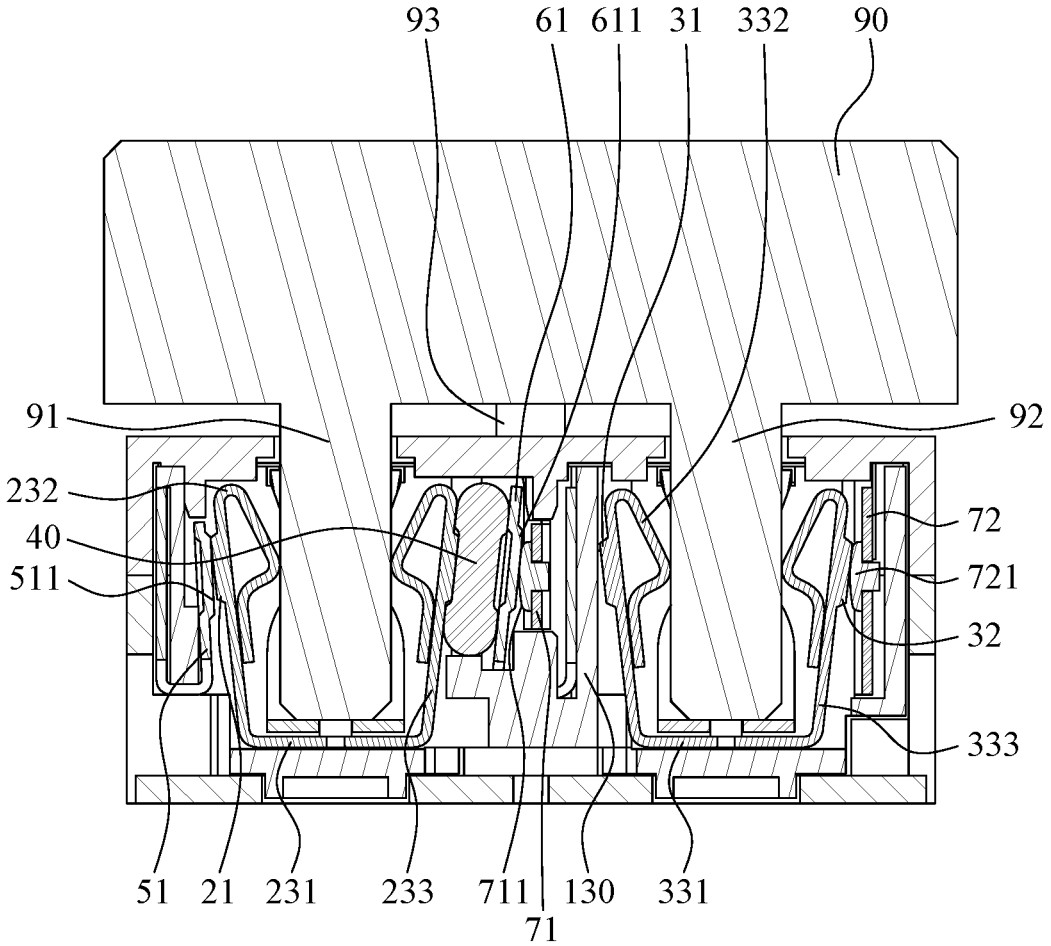
FIG. 9 is a schematic view showing a plug plugged into the safety socket of the present invention.

Referring to FIG. 9, FIG. 9 is a schematic view showing a plug plugged into the safety socket of the present invention. The plug 90 has a neutral-wire insert 91, a live-wire insert 92, and a ground-wire insert 93. The length of the neutral-wire insert 91 is greater than the minimum distance between the neutral-wire elastic pieces 232, 233, and the width of the neutral-wire insert 91 is greater than the minimum distance between the neutral-wire clips 242, 243. The length of the live-wire insert 92 is longer than the minimum distance between the live-wire springs 332, 333, and the width of the live-wire insert 92 is greater than the minimum distance between the live-wire clips 342, 343. When the neutral-wire insert 91 passes through the neutral-wire socket hole 111 and enters the neutral-wire socket 25, the neutral-wire clips 242, 243 clamp the two sides of the neutral-wire insert 91, and the neutral-wire elastic pieces 232, 233 are pushed by the two ends of the wire-wire insert 91, so that the neutral-wire elastic pieces 232, 233 pivot outward relatively to the neutral-wire elastic connection portion 231. The contact 21 contacts the contact 51, so that the neutral-wire insert 91, the neutral-wire elastic body 23 and the neutral-wire wiring terminal 50 are in a conductive state. The neutral-wire elastic piece 233 pushes the insulator 40, the insulator 40 further pushes the contact portion 61, the contact 611 contacts the contact 711, and the contact 711 contacts the surface of the contact portion 71.

When the live-wire insert 92 passes through the live-wire socket hole 112 and enters the live-wire socket 35, the live-wire clips 342, 343 clamp the two sides of the live-wire insert 92, and the live-wire elastic pieces 332, 333 are pushed by the two ends of the live-wire insert 92 which causes the hot-wire elastic pieces 332, 333 to pivot outward relatively to the live-wire elastic connection portion 331. The contact 31 contacts the partition wall 130, the contact 32 contacts the contact 721, and the contact 721 contacts the surface of the contact portion 72, so that the live-wire insert 92, the live-wire elastic body 33, the live-wire connection piece 70 and the live-wire wiring terminal 60 are in a conductive state. status. The ground-wire insert 93 enters a ground-wire socket 82 (see FIG. 4) of the ground-wire conductive base 80 through the ground-wire socket hole 113 and contacts the ground-wire conductive base 80 to guide current into the ground to prevent electric shock.

As shown in FIG. 8, when the neutral-wire insert 91 is detached from the neutral-wire socket hole 111 and the neutral-wire socket 25, the neutral-wire elastic pieces 232, 233 pivot inwardly to reset to the initial positions by the elastic force so that the contact 21 is away from the contact 511. Therefore, the neutral-wire insert 91, the neutral-wire elastic body 23, and the neutral-wire wiring terminal 50 are in a disconnected state. As shown in FIG. 8, when the live-wire insert 92 is pulled away from the live-wire socket hole 112 and the live-wire socket 35, the live-wire elastic pieces 332, 333 pivot inwardly to reset to the initial positions by the elastic force, so that the contact 32 is away from the contact point 721, the contact portion 61 is reset to the initial position by pivoting outwards at the same time by the elastic force, and the insulator 40 is pushed back to the initial position to continue to abut the neutral-wire elastic piece 233, so that the contact 611 is away away from the contact 711. Therefore, the live-wire insert 92, the live-wire elastic body 33, the live-wire connection piece 70 and the liv-wire wiring terminal 60 are in a disconnected state.

When a person without common sense of electricity (such as a child) inserts a conductive non-plug foreign body such as a metal rod, wire, nail, tweezers, fingers, etc. into the neutral-wire socket 25 and the live-wire socket 35, because the size of the conductive non-plug foreign body does not match the size of the neutral-wire socket 25 and the size of the live-wire socket 35, the conductive non-plug foreign body cannot open the neutral-wire elastic pieces 232, 233 and the live-wire elastic pieces 332, 333. As long as the neutral-wire elastic pieces 232 and 233 and the live-wire elastic pieces 332, 333 are not stretched, the neutral-wire elastic pieces 233 cannot push the insulator 40, so that the insulator 40 cannot push the contact portion 61. Therefore, the contact 21 does not contact the contact 511, the contact 611 does not contact the contact 711, and the contact 32 does not contact the contact 721, so that the neutral-wire elastic body 23 and the neutral-wire wiring terminal 50 are kept in a disconnected state, and the live-wire elastic body 33, the live-wire connection piece 70, and the live-wire wiring terminal 60 are also maintained in a disconnected state. Therefore, the present invention can effectively prevent electric shock when a conductive non-plug foreign body is inserted to provide high safety.

Furthermore, the neutral-wire elastic pieces 232, 233 and the live-wire elastic pieces 332, 333 can be reset by the elastic force, without the need to assist the reset through external springs. It is not necessary to dispose any through-holes on the neutral-wire socket terminal 24, live-wire socket terminal 34, and the mounting base 13 for the pivoted rotation of the neutral-wire elastic pieces 232, 233 and the live-wire elastic pieces 332, 333. Therefore, the overall structure of the neutral-wire conductive base 20 and the live-wire conductive base 30 is simplified and easy to assemble, to achieve effectively reducing manufacturing costs, and facilitating mass production.

In addition, because all the components of the present invention are properly configured, only a single insulator 40 and a single live-wire connection piece 70 are required to provide conductivity mode through three contacts (i.e., the contact 21 contacts the contact 511, the contact 611 contacts the contact 711, and the contact 32 contacts the contact 721) when the plug 90 is inserted into the safety socket of the present invention. Therefore, the overall structure of the present invention is simplified and easy to assemble, to achieve effectively reducing manufacturing costs, and facilitating mass production.

Furthermore, as shown in FIG. 2, the bottom base 12 is provided with a plurality of holes for heat dissipation, which helps the present invention to dissipate heat in normal usage. Similarly, the holes can also be used for drainage, which helps the present invention to drain water in a humid environment, avoids the risk of current leakage, and achieves the waterproof effect in case of splashing.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A safety socket, comprising:

a neutral-wire conductive base, having a first end and a second end, and the first end of the neutral-wire conductive base having a contact;

a live-wire conductive base, having a first end and a second end, and the second end of the live-wire conductive base having a contact;

an insulator, disposed between the second end of the neutral-wire conductive base and the first end of the live-wire conductive base;

a neutral-wire wiring terminal, having a contact, the contact of the neutral-wire wiring terminal being close to the contact of the first end of the neutral-wire conductive base, and the neutral-wire wiring terminal being used to connect a wire;

a live-wire wiring terminal, disposed between the first end of the live-wire conductive base and the insulator, and having a contact; the live-wire wiring terminal being used to connect another wire; and a live-wire connection piece, having two contacts, and the contacts of the live-wire connection piece being respectively close to the contact of the second end of the live-wire conductive base and the contact of the live-wire wiring terminal.

2. The safety socket according to claim 1, wherein the neutral-wire conductive base comprises a neutral-wire elastic body and a neutral-wire socket terminal, the neutral-wire elastic body comprises a neutral-wire elastic connection portion and two neutral-wire elastic pieces, and the neutral-wire elastic connection portion connects the two neutral-wire elastic pieces at bottom end, a contact is provided on one outer side of each of the neutral-wire elastic pieces, the neutral-wire elastic pieces are respectively located at the first end and the second end of the neutral-wire conductive base; the neutral-wire socket terminal comprises a neutral-wire socket connection portion and two neutral-wire clips, the neutral-wire socket connection portion is connected to the bottom ends of the neutral-wire clips, the neutral-wire socket connection portion is located above the neutral-wire elastic connection portion, the neutral-wire elastic pieces and the neutral-wire clips constitute a neutral-wire socket; and wherein the live-wire conductive base comprises a live-wire elastic body and a live-wire socket terminal, the live-wire elastic body comprises a live-wire elastic connection portion and two live-wire elastic pieces, and the live-wire elastic connection portion connects the two live-wire elastic pieces at bottom end, a contact is provided on one outer side of each of the live-wire elastic pieces, the live-wire elastic pieces are respectively located at the first end and the second end of the live-wire conductive base; the live-wire socket terminal comprises a live-wire socket connection portion and two live-wire clips, the live-wire socket connection portion is connected to the bottom ends of the live-wire clips, the live-wire socket connection portion is located above the live-wire elastic connection portion, the live-wire elastic pieces and the live-wire clips constitute a live-wire socket.

3. The safety socket according to claim 2, wherein the safety socket further comprises a mounting base, the mounting base is recessed with a neutral-wire positioning slot and a live-wire positioning slot; wherein a neutral-wire positioning post protruding upward is disposed at a bottom of the neutral-wire positioning slot, one of the neutral-wire clips is disposed with a neutral-wire positioning portion protruding from one side, the neutral-wire positioning portion is disposed with a neutral-wire through-hole, the neutral-wire positioning portion is located in the neutral-wire positioning slot, and the neutral-wire positioning post is disposed in the neutral-wire through-hole penetratingly; and wherein, a live-wire positioning post protruding upward is disposed at a bottom of the live-wire positioning slot, one of the live-wire clips is disposed with a live-wire positioning portion protruding from one side, the live-wire positioning portion is disposed with a live-wire through-hole, the live-wire positioning portion is located in the live-wire positioning slot, and the live-wire positioning post is disposed in the live-wire through-hole penetratingly.

4. The safety socket according to claim 3, wherein two neutral-wire steps are formed at two sides of the neutral-wire positioning slot, and two neutral-wire limiting posts protruding upward are disposed at the bottom of the neutral-wire positioning slot, and the neutral-wire limiting posts are respectively located on both sides of the neutral-wire positioning post; the bottom of the neutral-wire positioning portion abuts against tops of the neutral-wire steps and the neutral-wire limiting posts, so that the neutral-wire socket terminal is hung, and the bottom of the neutral-wire socket connection portion and the top of the neutral-wire elastic connection portion are maintained at a distance; and two live-wire steps are formed at two sides of the live-wire positioning slot, and two live-wire limiting posts protruding upward are disposed at the bottom of the live-wire positioning slot, and the live-wire limiting posts are respectively located on both sides of the live-wire positioning post; the bottom of the live-wire positioning portion abuts against tops of the live-wire steps and the live-wire limiting posts, so that the live-wire socket terminal is hung, and the bottom of the live-wire socket connection portion and the top of the live-wire elastic connection portion are maintained at a distance.

5. The safety socket according to claim 2, wherein the safety socket further comprises a mounting base, the mounting base is disposed with two neutral-wire positioning blocks and two live-wire positioning blocks; wherein a notch is disposed on one side of the neutral-wire elastic connection portion and the neutral-wire socket terminal is disposed with a socket groove, the socket groove of the neutral-wire socket terminal extends from one of the neutral-wire clips to the other neutral-wire clip through the neutral-wire connection portion, and one of the neutral-wire positioning blocks is located at the notch of the neutral-wire elastic connection portion and the socket grove of the neutral-wire socket terminal and located under one of the neutral-wire clips, and the other neutral-wire positioning block is located in the socket groove of the neutral-wire socket terminal and located under the other neutral-wire clip; wherein a notch is disposed on one side of the live-wire elastic connection portion and the live-wire socket terminal is disposed with a socket groove, the socket groove of the live-wire socket terminal extends from one of the live-wire clips to the other live-wire clip through the live-wire connection portion, and one of the live-wire positioning blocks is located at the notch of the live-wire elastic connection portion and the socket grove of the live-wire socket terminal and located under one of the live-wire clips, and the other live-wire positioning block is located in the socket groove of the live-wire socket terminal and located under the other live-wire clip.

6. The safety socket according to claim 1, wherein the neutral-wire wiring terminal comprises a contact portion and a wiring portion, the contact portion of the neutral-wire wiring terminal is close to the first end of the neutral-wire conductive base and is disposed with a contact, and the wiring portion of the neutral-wire wiring terminal is used for connection to an electric wire; the live-wire wiring terminal comprises a contact portion and a wiring portion; the contact portion of the live-wire terminal is close to the insulator and is disposed with a contact; the wiring portion of the live-wire wiring terminal is used for connection to another electric wire; wherein the live-wire connection piece comprises two contact portions, one of the contact portions of the live-wire connection piece is near the second end of the live-wire conductive base and is disposed with a contact, and the other contact portion of the live-wire connection piece is located between the contact portion and the wiring portion of the live-wire wiring terminal and is disposed with a contact.

7. The safety socket according to claim 6, wherein the safety socket further comprises a mounting base, and the mounting base surrounds a neutral-wire conductive base receptacle, a live-wire conductive base receptacle, an insulator receptacle, a live-wire wiring terminal receptacle, and a live-wire connection piece receptacle; the live-wire wiring terminal receptacle is located between the neutral-wire conductive base receptacle and the live-wire conductive base receptacle, and the insulator receptacle is connected between the neutral-wire conductive base receptacle and the live-wire wiring terminal receptacle, the live-wire connection piece receptacle surrounds outer side of the live-wire conductive base receptacle with two ends communicating with the live-wire wiring terminal receptacle and the live-wire conductive base receptacle respectively; the neutral-wire conductive base is disposed in the neutral-wire conductive base receptacle, the live-wire conductive base is disposed in the live-wire conductive base receptacle, the insulator is disposed in the insulator receptacle, the contact portion of the neutral-wire wiring terminal is located in the neutral-wire conductive base receptacle, and the live-wire wiring terminal is disposed in the live-wire wiring terminal receptacle; the live-wire connection piece comprises a connection portion, and the connection portion of the live-wire connection piece is connected to the contact portions of the live-wire connection piece and is disposed in the live-wire connection piece receptacle, the contact portions of the live-wire connection piece respectively extend into the live-wire conductive base receptacle and the live-wire wiring terminal receptacle.

8. The safety socket according to claim 7, wherein the mounting base has a partition wall, which partitions the live-wire conductive base receptacle from the live-wire wiring terminal receptacle.

9. The safety socket according to claim 6, wherein two surfaces of the insulator abut against the contact portions between the second end of the neutral-wire conductive base and the contact portion of the live-wire wiring terminal, respectively.

10. The safety socket according to claim 6, wherein the contacts of the live-wire connection piece are all silver contacts and are detachably disposed on the contact portions of the live-wire connection piece, respectively.

* * * * *